United States Patent [19]

Ganon

[11] Patent Number: 5,033,144

[45] Date of Patent: Jul. 23, 1991

[54] SLIPPER AND METHOD OF MAKING SAME

[75] Inventor: Michael H. Ganon, Bexley, Ohio

[73] Assignee: R. G. Barry Corporatoin, Pickerington, Ohio

[21] Appl. No.: 337,076

[22] Filed: Apr. 12, 1989

[51] Int. Cl.[5] ..... A43B 3/16; A43B 1/14; A43B 7/12

[52] U.S. Cl. ..... 12/142 G; 36/9 R; 36/71 R

[58] Field of Search ..... 36/9 R, 11, 12, 7.1 R; 12/142 G

[56] References Cited

U.S. PATENT DOCUMENTS

| | | | |
|---|---|---|---|
| Re. 33,018 | 8/1989 | Ostrander | 36/9 R |
| 1,194,467 | 8/1916 | Bickford | 36/9 R |
| 1,201,927 | 10/1916 | Blum | 12/142 G |
| 1,262,026 | 4/1918 | Dillberg | 36/9 R |
| 1,348,941 | 8/1920 | Green | 36/9 R |
| 1,640,362 | 8/1927 | Mahler et al. | 36/142 G |
| 1,754,272 | 4/1930 | Jorgensen | 36/145 |
| 1,795,305 | 3/1931 | Jacob | 36/9 R |
| 1,916,067 | 6/1933 | Naidor | 36/9 R |
| 3,015,171 | 1/1962 | Kaplan | 36/9 R |
| 3,052,046 | 9/1962 | Kramer | 36/9 R |
| 3,063,074 | 11/1962 | Scholl | 12/142 G |
| 3,199,132 | 8/1965 | Newman | 12/142 G |
| 3,228,050 | 1/1966 | Wall | 36/11 |
| 3,345,762 | 10/1967 | Fisher et al. | 36/9 R |
| 3,491,390 | 1/1970 | Greenblatt et al. | 36/9 R |
| 3,798,503 | 3/1979 | Larsh et al. | 36/9 R |
| 3,801,868 | 4/1974 | Bryant | 36/9 R |
| 4,616,428 | 10/1986 | Leger | 12/142 G |

FOREIGN PATENT DOCUMENTS

| | | | |
|---|---|---|---|
| 2276011 | 1/1976 | France | 36/9 R |
| 926381 | 5/1963 | United Kingdom | 36/9 R |

*Primary Examiner*—Steven N. Meyers

*Attorney, Agent, or Firm*—Watson, Cole, Grindle & Watson

[57] ABSTRACT

A method of making a slipper is disclosed. The method comprises attaching heel portions of an innersole and sock. A vamp is attached to the innersole/sock structure. A filler is inserted through an opening between the innersole and sock by clamping the filler and pulling the innersole/sock/vamp structure over the filler. A binding is secured to the periphery of the slipper structure to close said opening. A sole pad thereafter is attached.

16 Claims, 6 Drawing Sheets

90
92
52
98
110

106
114
104
52
116
110
98
112
108

120
122
72
124
128

72
72
72
124
126
70b
128
70a 138
150
152
142
156
140
136
153
154

70b
130
132
60
50
138
142
140
134
136
70a 160
80
162
166
164
84

80
160
166
162
164

SLIPPER AND METHOD OF MAKING SAME

BACKGROUND OF THE INVENTION

The present invention relates to slippers, and more particularly to slippers of the scuff or ballerina type having a binding extending around the lower periphery thereof.

In prior art slippers of this type, the cushioning material at the bottom of the slipper for supporting the foot is disposed within the binding. When the binding is sewn to the sole pad, the stitching passes through the cushioning material causing the cushioning material to twist such that the slipper will not sit flat and tends to curl up at the opposite ends thereby producing an undesirable appearance.

Furthermore, the thickness of the cushioning material in such prior art slippers is limited since if it gets too thick, the binding necessarily becomes thicker, and such thicker bindings become wrinkled and have an unsatisfactory appearance. The limited thickness of the cushioning material restricts the comfort of the slipper, since a greater thickness of cushioning material will provide enhanced comfort to a wearer.

SUMMARY OF THE INVENTION

The present invention overcomes the disadvantages of known slippers by providing a novel arrangement wherein the cushioning material is not compressed and is free of any stitching. The cushioning material is not disposed within the binding, but is confined within a space provided within the slipper. As a result, the cushioning material may be made substantially thicker while retaining a binding of minimal thickness. Additionally, the finished slipper appears to sit substantially flat on its sole pad, and any tendency of the ends of the slipper to curl up is minimized.

The above advantages are obtained by making the slipper according to a novel method which reduces errors and problems which may occur during the manufacturing process. An innersole means is attached to a sock means, leaving an opening at the toe portions thereof. A vamp means is attached to the sock means and innersole means leaving the opening at the toe portions of the innersole means and sock means. A filler means of cushioning material is inserted through the toe opening into the space between the innersole means and the sock means. A binding means is then attached to the vamp means, sock means and innersole means, closing the toe opening. A sole pad means is then attached to complete the slipper.

DESCRIPTION OF THE PREFERRED EMBODIMENTS

As used throughout the description, the term "right side" denotes the surface of a component which faces outwardly of the slipper and which is viewed by an observer. The term "wrong side" denotes the surface of a component which faces inwardly of the slipper and which is normally not seen by an observer.

Furthermore, it will be understood that some of the components of the slippers will be slightly different for the right and left foot slippers as is well-known in the art. The methods of making the right and left slippers are substantially the same except where indicated.

Figure 1:
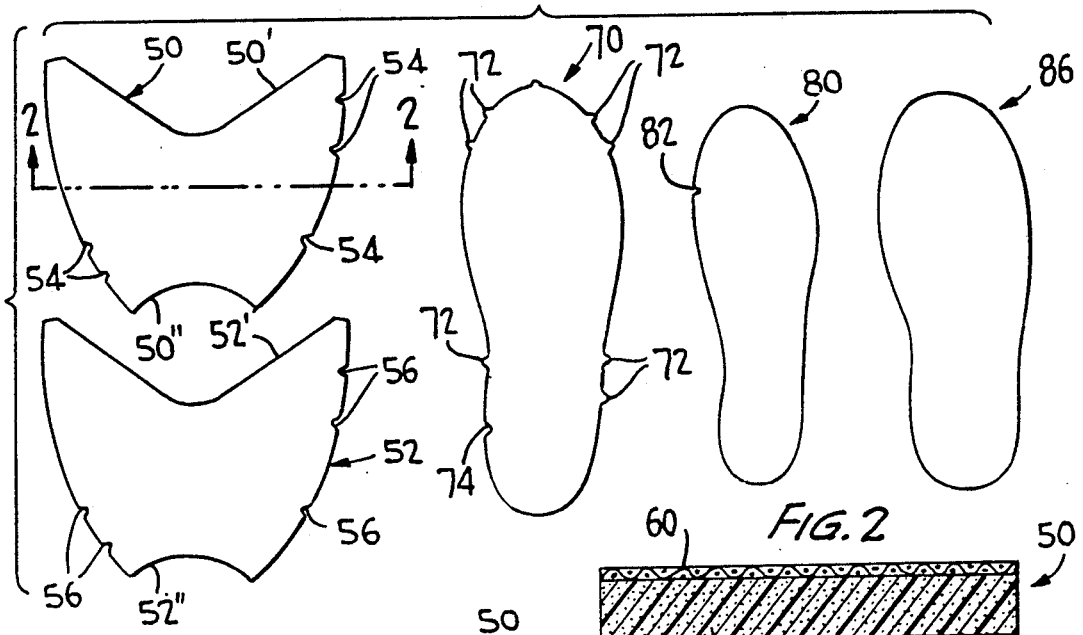
FIGS. 1-16 illustrate the method of making a scuff type of slipper.

Referring now to the drawings wherein like reference characters designate corresponding parts throughout the several views, FIG. 1 illustrates the components from which a scuff type of slipper is made. A vamp means includes a vamp 50 and a vamp lining 52 of a configuration similar to that of the vamp. Vamp 50 has aligning notches 54 formed at spaced points about the periphery thereof; and vamp lining 52 has aligning notches 56 formed at spaced points about the periphery thereof. The vamp and vamp lining are the only components of this form of slipper which are not provided in both a right and left foot version.

Figure 2:
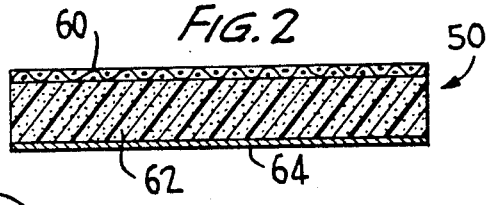

As seen in FIG. 2, which is a sectional view taken along line 2—2 of FIG. 1 looking in the direction of the arrows, vamp 50 includes a top layer 60 of stretch terrycloth, the upper surface of which is the right or loop side. The lower surface or wrong side of layer 60 is smooth and faces downwardly toward a relatively thick layer 62 of material such as polyether synthetic foam which makes the vamp puffy and soft. The lower surface of layer 60 is bonded to the upper surface of layer 62 by a suitable adhesive material.

Figure 17:
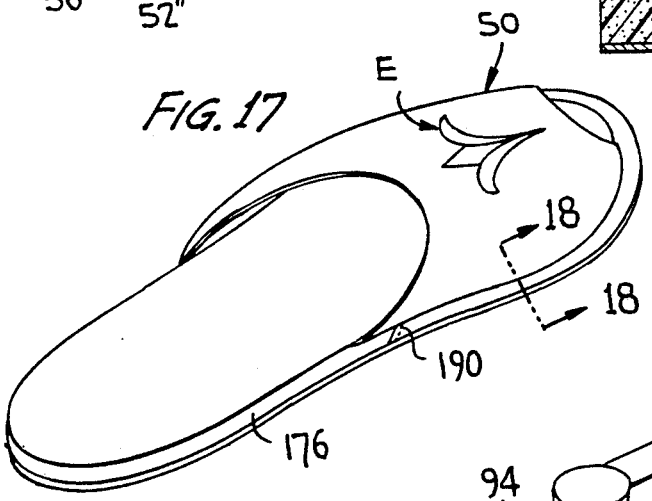
FIG. 17 is a top perspective view of a finished scuff type of slipper.

A bottom layer 64 is formed of a thin tissue-like material such as Pellon, a product of Haskell Lining, Inc. of New York, N.Y. Layer 64 is provided to facilitate embroidering the vamp; and after the embroidery is completed, layer 64 is torn away and discarded. As shown in FIG. 17, vamp means 50 of the finished slipper is provided with an embroidered design E. This embroidered design may be eliminated if desired, and in such a case, layer 64 may be eliminated from the vamp. The embroidering step is carried out with conventional equipment in the usual manner. The lining 52 comprises cloth made of a cotton and polyester blend.

As seen in FIG. 1, reference character 70 designates a configuration which is utilized in both the innersole means and sock means of the slipper. In the case of the innersole means, the material is Pellon, and in the case of the sock means, the material is stretch terrycloth. Configuration 70 includes a plurality of out notches 72 formed at spaced points about the periphery thereof as well as an in notch 74.

A filler means 80 is provided with an in notch 82 formed in the periphery thereof. The filler means is formed of a body of cushioning material such as polyether synthetic foam and may have a substantial thickness on the order of $\frac{3}{4}$ inch. An outsole pad means 86 is formed of a suitable synthetic rubber or the like which is soft and flexible and which at the same time has good wearing qualities.

Figure 3:
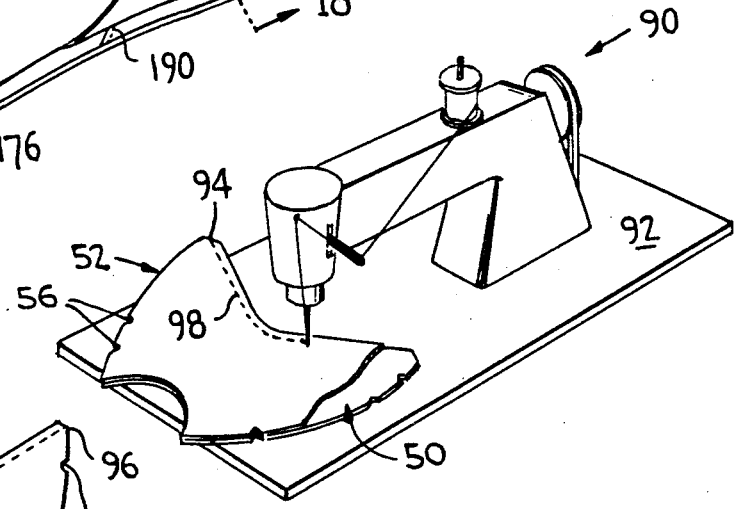
Figure 4:
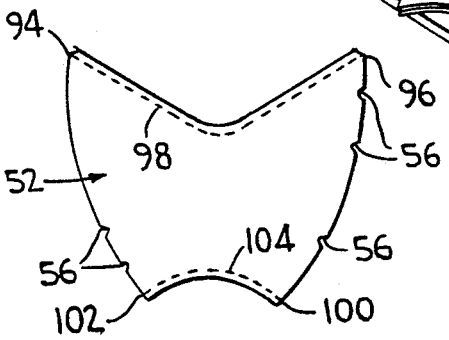

Referring now to FIGS. 3 and 4 of the drawings, a conventional sewing machine 90 having a support surface 92 is employed for attaching the vamp to the vamp lining. The vamp is placed on the support surface with the right side of the vamp facing up with the throat toward the machine foot. The lining is then placed with the right side thereof facing down on top of the vamp such that the right side of the vamp is in facing relationship to the right side of the vamp lining.

The throat edges 50' and 52' as well as the notches 54 and 56 of the vamp and vamp lining respectively are aligned with one another, and these components are attached to one another by sewing. The sewing is started at one throat point 94 and continues around the lining throat, maintaining the throat contour. The sewing continues to the opposite throat point 96 to form a line of stitching 98. The vamp and vamp lining are then repositioned with the toe edges 50'' and 52'' of the vamp and vamp lining aligned with one another. The sewing starts at one toe point 100 and continues to the opposite toe point 102 to form a line of stitching 104.

Figures 5, 6, 7, 8, 9, 10, 11, 12:
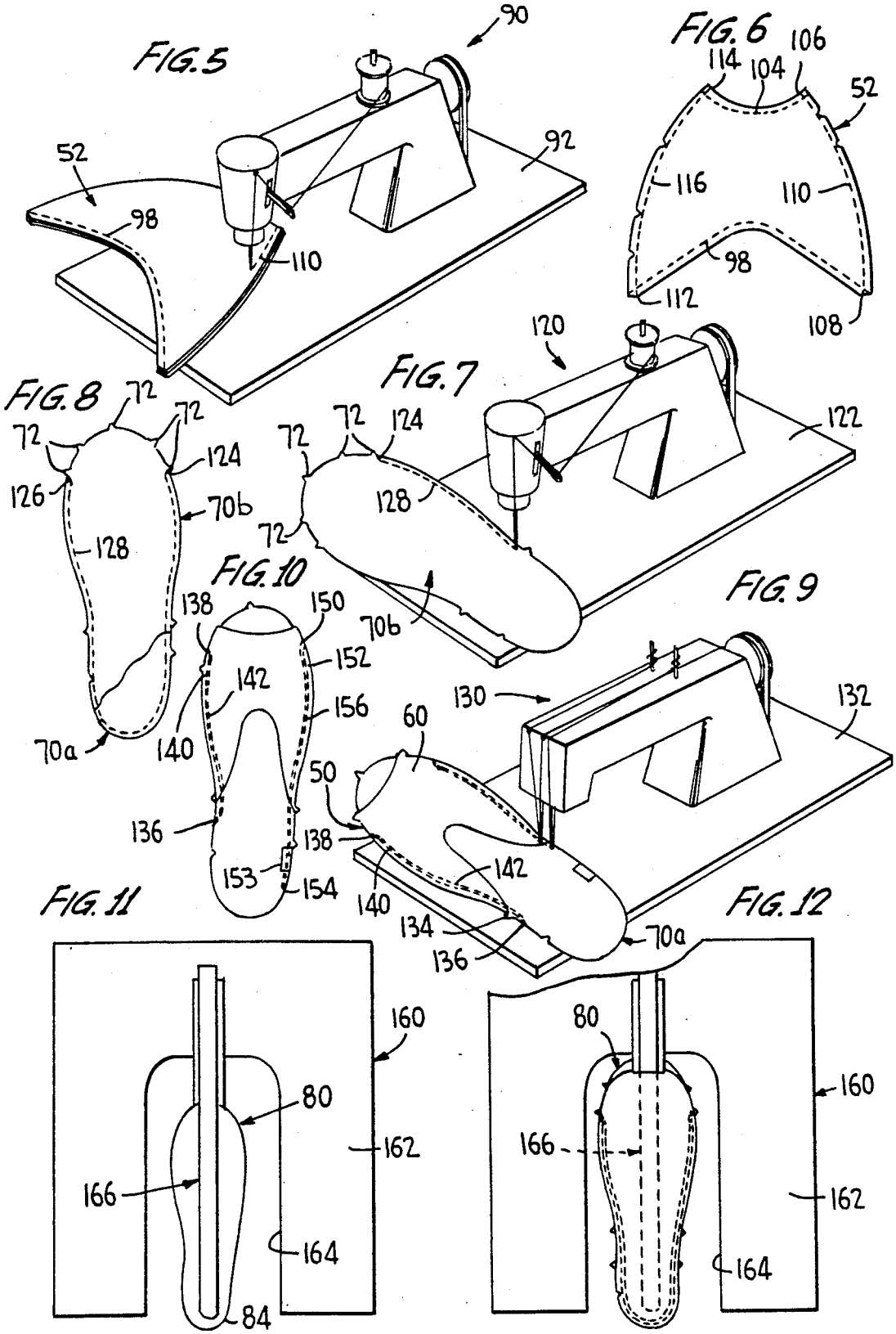

The vamp and vamp lining are then turned inside out so that the right sides of the two components face away from one another and are presented to view. Further portions of the vamp and vamp lining are then attached to one another. Referring now to FIGS. 5 and 6, the vamp is then placed on the support surface of the machine with the lining side up. The vamp and vamp lining side edges are aligned. Sewing is then started at toe point 106 and continues to throat point 108 to form a line of stitching 110. The vamp is then repositioned on the machine with the lining side up and the opposite side toward the machine foot. Sewing is started at throat point 112 and continues to toe point 114, forming a line of stitching 116. FIG. 6 illustrates the vamp and vamp lining in fully attached relationship.

Referring now to FIGS. 7 and 8, the heel and side portions of the innersole means and sock means are attached to one another while leaving an opening at the toe portions thereof. A conventional sewing machine 120 having a support surface 122 is provided. A sock means **70*a* formed of stretch terrycloth is placed on the machine with the wrong or smooth side up and with the heel toward an operator. An innersole means 70*b*** is placed on top of the sock means with the innersole means facing the wrong side of the sock means, and the out notches and edges on the innersole means and sock means are aligned.

Sewing is started at point 124 at the second out notch from the toe and continues toward the heel. The heel edges are aligned, and sewing continues to a point 126 at the second out notch on the opposite side of the innersole means thereby forming a line of stitching 128.

Referring now to FIGS. 9 and 10, the vamp means is attached to the innersole means and sock means, leaving an opening at the toe portions of the innersole means and sock means. A conventional walking foot machine 130 having a support surface 132 is set up with a ⅛ inch gauge with an outside altered foot and a roller gauge to double needle the vamp means to the sock means and innersole means.

The right sock means is placed on the machine with the right or loop side up and the toe toward an operator. The vamp means is placed right side up on the sock means so that the wrong side of the vamp means is facing the right side of the sock means. The right vamp throat point 134 is placed on the sock means and is aligned with the first side out notch of the sock means from the heel.

Sewing is then started at point 136 approximately one inch in back of the outnotch. The sewing continues toward the toe to a point 138. A backtack of ½ inch is formed to a point 140, and the operator sews off the vamp means thereby forming a double line of stitching 142. On the opposite side of the slipper, a backtack is formed between points 150 and 152. Sewing continues from point 150 toward the heel. A label 153 may be secured to the slipper by sewing through the label to a point 154 approximately ½ inch past the label thereby forming a double line of stitching 156.

In order to sew the left vamp means to the left sock means, the method steps are repeated, except the label may be eliminated and the point 154 moved to about one inch behind the vamp means throat point. Double lines of stitching are formed in the left slipper similar to the lines of stitching 142 and 156 formed in the right slipper.

Referring now to FIGS. 11 and 12, the filler means is inserted through the opening at the toe portions of the innersole means and sock means into the space therebetween. An inserting machine 160, shown in plan view, is provided for inserting the filler means within the slipper. The machine includes a table portion 162 having a generally U-shaped cut-out 164 into the center of which extends elongated flat clamping means 166 in the form of two flat clamping members which may be moved vertically into and out of clamping relationship to one another. The clamping means is operated by a foot pedal (not shown).

Since the slipper and filler means are left and right, care must be taken to match them accordingly. Filler means 80 is inserted into the clamping means between the clamping members as shown in FIG. 11 with the heel 84 toward the operator and the heel edge extending about ¼ inch beyond the end of the clamping means so that the slipper will have a puff appearance after filling. The foot pedal is then pressed to clamp the filler means and hold it in place.

The slipper is then placed on the table with the innersole means facing up. The operator grasps the sides of the slipper at the toe opening with the finger tips and with the toe opening of the slipper receiving the heel of the filler means. The slipper is then pulled over the clamping means and filler means until the filler means abuts the heel edge of the slipper. The foot pedal is then released so that the filler means is no longer clamped in place by the clamping means. The operator then grasps the open end of the slipper and particularly the filler means as the slipper is pulled from the clamping means of the inserting machine.

Figure 13:
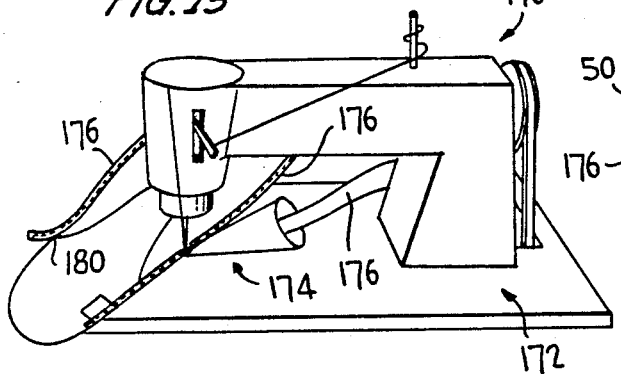
Figure 14:
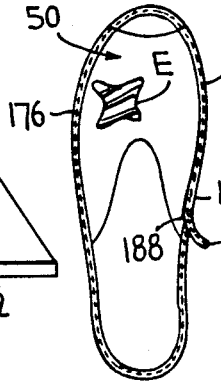
Figure 15:
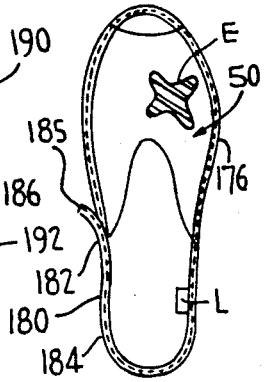
Figure 18:
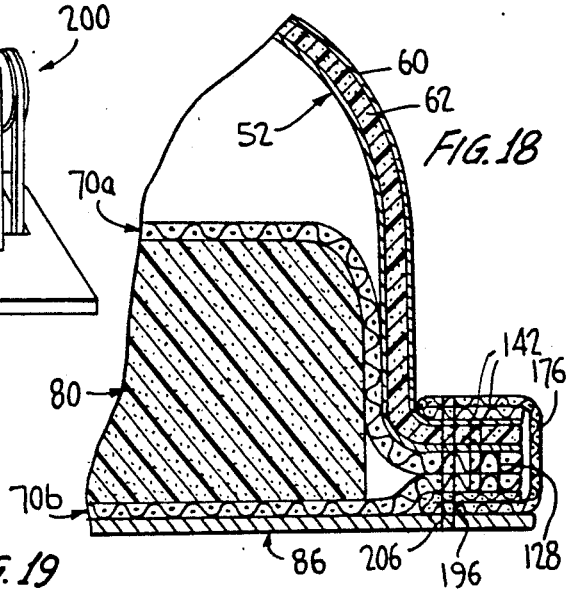
FIG. 18 is a cross-sectional view taken along line 18—18 of FIG. 17 looking in the direction of the arrows.

Referring now to FIGS. 13–15, the manner of binding around the slipper is shown. A conventional walking foot machine 170 having a support surface 172 is provided. A folder 174 receives binding means 176 fomr a suitable supply source. The folder is of such a construction as to produce a double fold in the binding means. The double fold provides a space for receiving peripheral portions of the innersole means, sock means and vamp means. The double folded cross-sectional configuration of the binding means 176 is shown in FIG. 18.

A right slipper as seen in FIGS. 13 and 15 is positioned right side up into folder 174. The binding means is applied by starting to sew at a point 180 about ¾ inch behind the tail-off point 182 and sewing toward the toe. The toe ends of the vamp means are aligned and sewing continues around the toe to the opposite side of the slipper.

The binding means is then cut flush with the slipper contour at the starting point 180. Sewing then continues toward and around the heel to the starting point. Sewing continues beyond the starting point to the tail off point 182, forming a line of stitching 184. The operator then chains off at a 45 degree angle to a left slipper with a binding tail 185 having a length of about one inch.

A left slipper as shown in FIG. 14 is then positioned right side up into folder 174. The binding means is applied by starting to sew at a point 186 about ¾ inch in front of the tail-off point 188 and sewing toward and around the heel to the opposite side of the slipper. The binding tail 184 is then cut flush with the contour of the left slipper at point 186.

Sewing then continues toward and around the toe of the left slipper to the starting point 186. Sewing continues beyond the starting point to the tail-off point 188, forming a line of stitching 190. The operator then chains off at a 45 degree angle to a right slipper with a binding tail 192 having a length of about one inch. The method shown in FIGS. 13–15 then continues with another right slipper.

The steps as shown in FIGS. 13–15 serve to attach peripheral portions of the binding means to peripheral portions of the innersole means, sock means and vamp means. The peripheral portions of the innersole means, sock means and vamp means are received within the space defined by the double folded binding means. In addition, the opening at the toe portions of the innersole means and sock means is permanently closed.

Figure 16:
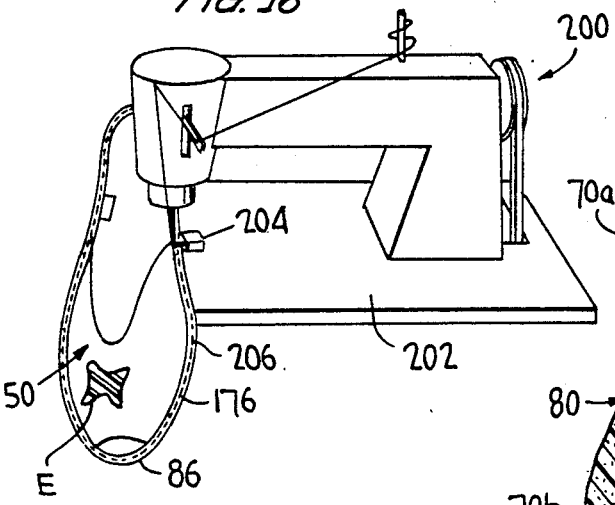

Referring now to FIG. 16, the step of attaching the peripheral portions of the sole pad means to the innersole means, sock means, vamp means and binding means is illustrated. A conventional walking foot sewing machine 200 having a support surface 202 is provided. The machine is set up with one needle and a roller guide 204. The sole pad 86 may be provided with a suitable design on one side thereof, and the sole pad means is placed on surface 202 with the opposite or wrong side of the sole pad means facing up and the heel toward the operator. The bound components of the slipper are then placed on the sole pad means with the vamp means right side up. The bound edges of the slipper are aligned with the sole pad means edge toe to toe, heel to heel and side to side.

With the right slipper, sewing is started from the center of the heel toward the toe along the side opposite to that from which the binding tail extends. Sewing is continued to and around the toe letting the slipper move smoothly against the roller guide to follow the sole pad countour. The binding tail is folded between the innersole means and the sole pad means flush with the slipper contour. FIG. 16 illustrates the position where the binding tail has just been folded into place and the sewing has passed thereover to hold the components in position. Sewing continues to the starting point and about ¾ inch beyond the starting point to form a line of stitching 206.

With the left slipper, sewing is started from the center of the heel toward the toe along the side from which the binding tail extends. The binding tail is folded between the innersole means and the sole pad means flush with the slipper contour and sewing continues to and around the toe. Sewing then ;continues along the opposite side of the slipper, back to the starting point and about ¾ inch beyond the starting point to form a line of stitching similar to line 206 formed in the right slipper.

A completed left scuff slipper is shown in FIG. 17, and it will be noted that the binding tail means is folded between the sole pad means and innersole means at the portion of the instep where the stitching 190 extends diagonally downwardly. As seen in FIG. 18, the peripheral portions of the innersole means, sock means and vamp means are all received within the binding means and are interconnected with one another by the various attaching means, whereas the filler means is free of any attaching means.

Figure 19:
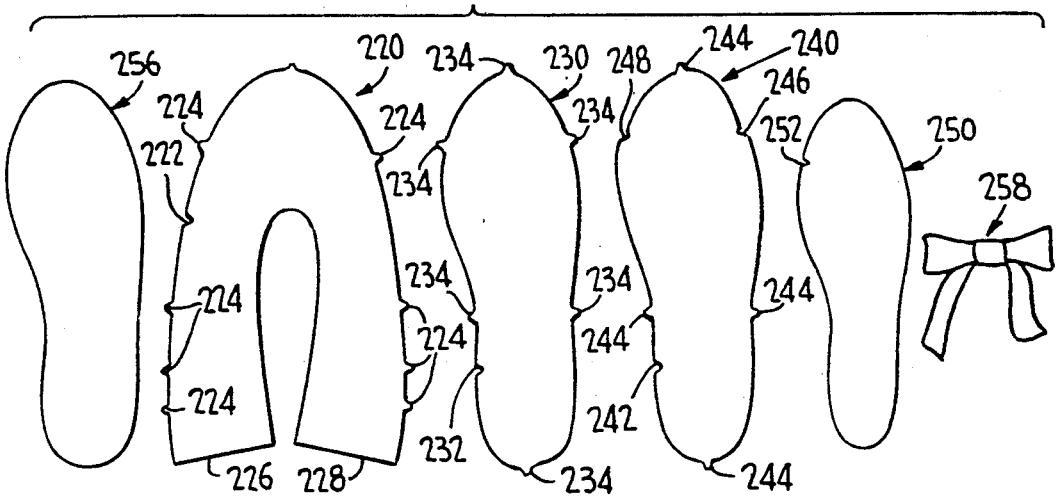
FIGS. 19-39 illustrate the method of making a ballerina type of slipper.

Referring now to FIG. 19, the components from which a ballerina type of slipper is made are illustrated. A vamp means 220 is formed of two layers of stretch terrycloth having the wrong sides thereof bonded together by a suitable adhesive. The vamp means has an in notch 222 as well as aligning out notches 224 formed at spaced points about the periphery thereof. The vamp means has a generally U-shaped configuration with opposite heel edges 226 and 228.

A sock means 230 is also formed of stretch terrycloth and has an in notch 232 as well as aligning out notches 234 formed at spaced points about the periphery thereof. An innersole means 240 is formed of Pellon and includes an in notch 242, a plurality of out notches 244 and a pair of extended points 246 and 248 formed at spaced points about the periphery thereof.

A filler means 250 of the same construction as filler means 80 previously described has an in notch 252 formed in the periphery thereof. A sole pad means 256 is of the same construction as the sole pad means 86 previously described. An ornament in the form of a bow 258 is formed of suitable ribbon or the like.

Figure 20:
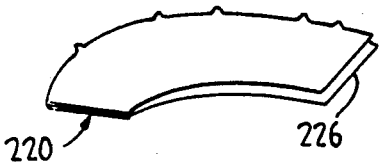
Figure 21:
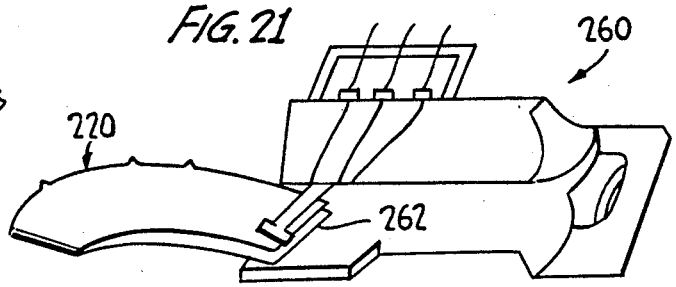
Figure 22:
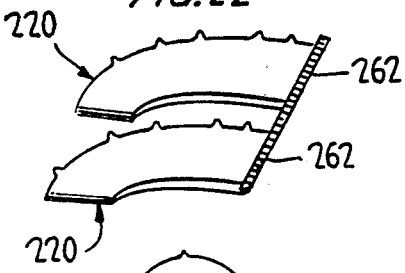

Referring to FIG. 20, the vamp means 220 is folded in half to bring the two right or loop sides of the vamp means into facing relationship, and the heel edges are aligned with one another. As seen in FIG. 21, a conventional serger or overcast sewing machine 260 is provided, and sewing of the vamp means is started at the bottom of the heel and continues to the top of the heel to stitch the heel edges together with a serge seam. The operator then chains to the next heel as shown in FIG. 22, leaving just enough space between the heels to cut them apart with a pair of scissors. However, the vamp means remain chained together for the topstitch operation next described.

Figure 23:
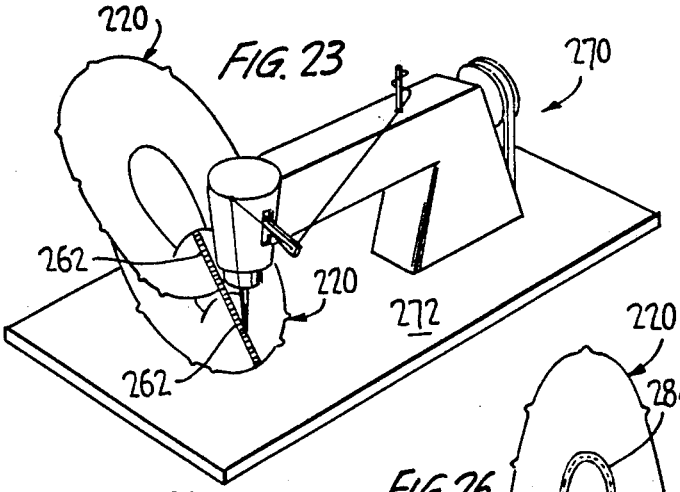
Figure 24:
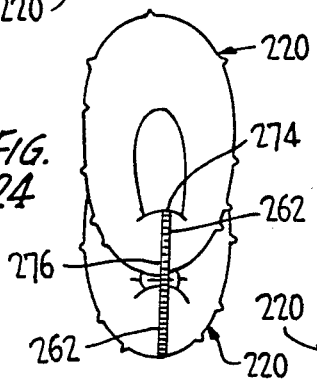

Referring to FIGS. 23 and 24, a conventional straight stitch sewing machine 270 having a support surface 272 is provided. The vamp means 220 are chained together and are on the wrong side. The serge seam 262 is folded to the side and sewing is started at a point 274 at the top of the heel and continues to a point 276 at the bottom of the heel thereby topstitching the serge seam. After the first slipper is topstitched, it is pushed under the foot of the machine and the heels are clipped apart before starting to topstitch the next slipper.

Figure 25:
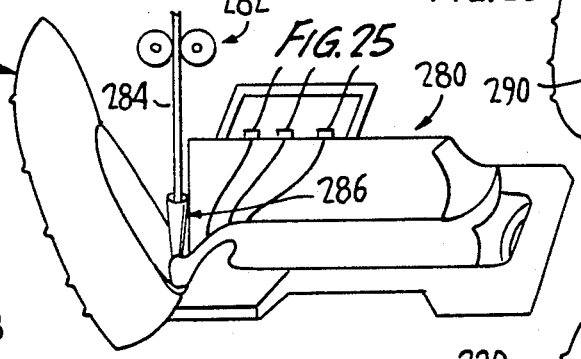

Referring now to FIG. 25, a conventional serger or overcast sewing machine 280 is provided. Supply means 282 provides a band of elastic 284 such as rubber to a folder 286 which folds the band in half to provide a space for receiving the upper edge of the throat of the vamp means. As seen in FIG. 25, the right side of the vamp means is facing outwardly, and the wrong side is to the machine foot and the heel to the operator.

Figure 26:
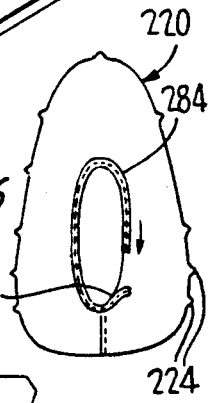

As seen in FIG. 26, a left vamp means is shown. The rubber is applied to the upper edge of the vamp means throat and sewing is started at a point 290 and continues toward and around the heel and thence along the throat back to starting point 290 and about ¾ inch therebeyond. The operator then chains to the next vamp means, leaving about a ¾ inch length of rubber between vamp means. The rubber is shown in FIG. 26 as having been applied to a point short of the starting point and illustrates an intermediate stage of the step.

Figure 27:
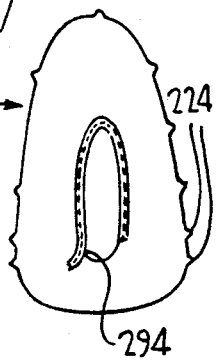

FIG. 27 shows a right vamp means which is placed right side up on the machine with the toe toward the operator and the wrong side facing the machine foot. The rubber is applied to the upper edge of the vamp means throat and sewing is started at a point 294 and continues toward and around the toe and thence along the throat back to starting point 294 and about ¾ inch therebeyond. The operator then chains to the next vamp means in the same manner as discussed in the previous paragraph. The rubber is shown in FIG. 27 as having been applied to a point short of the starting point and illustrates an intermediate stage of the step.

Figure 28:
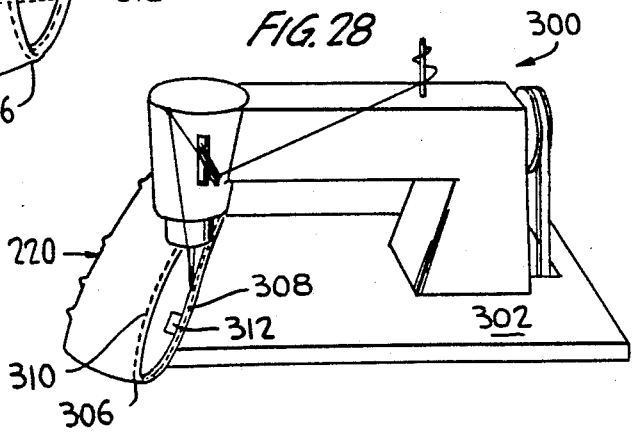

Referring to FIG. 28, the manner of top stitching the vamp means throat is illustrated. A conventional straight stitch sewing machine 300 having a support surface 302 is provided. The machine is set up with a finger guide. A right vamp means is placed right side up on the machine and the wrong side facing the machine foot, with the toe toward the operator.

Starting at the tail off point 306, the rubber is folded down to the inside of the vamp means. Sewing is started toward the toe about ¼ inch in front of point 306, folding the rubber down as the sewing continues around the toe to a point 308 forming a line of stitching 310. A label may then be applied if so desired.

Figure 29:
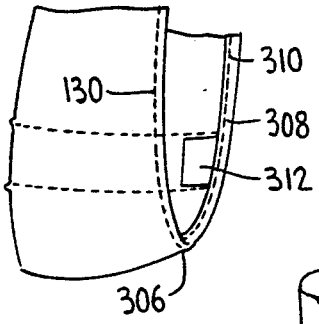

As seen in FIG. 29, the bottom edge of a label 312 is inserted with the wrong side up under the fold at the top of the vamp means. The label is held in place, and sewing continues to the starting point 306 and about ¾ inch beyond the starting point.

In the case of the left vamp means, the vamp means is placed right side up on the machine with the heel toward the operator. The method steps described above in connection with the right vamp are repeated, except the step of applying the label is eliminated.

Figure 30:
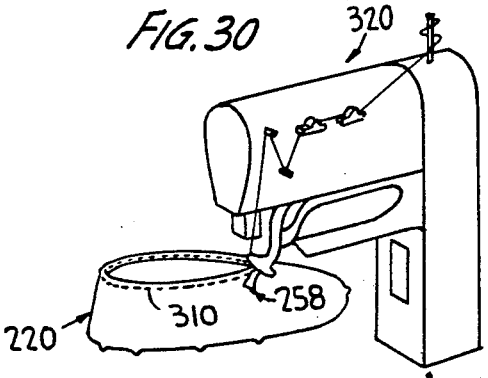
Figure 31:
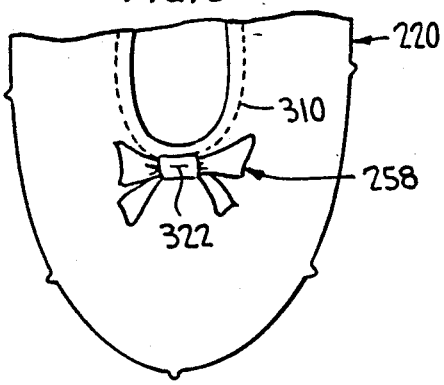

Referring now to FIGS. 30 and 31, a conventional tacker machine 320 is shown. The vamp means is placed right side up on the machine with the throat center toward the machine foot. The ornamental bow 258 is premade and is placed right side up on topstitch 310 at the vamp means throat center with the ends of the bow extending toward the toe. One tack 322 is then placed in the center of the bow to attach it is place.

Figure 32:
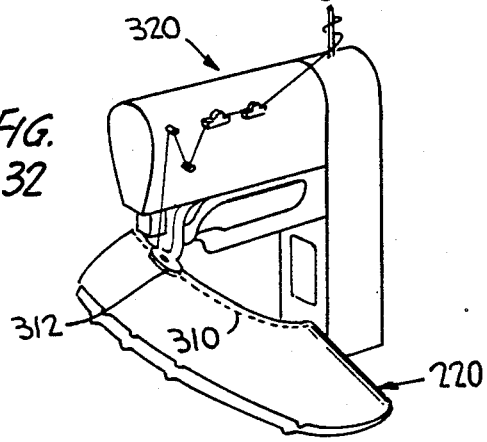
Figure 33:
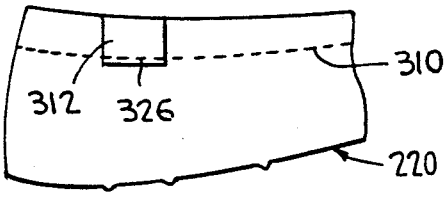

Referring to FIGS. 32 and 33, the manner of line tacking the label to the vamp means is illustrated. The vamp means is placed right side up on the tacker machine. The label 312 is then folded over the top of the vamp means throat, bringing the right side of the label to the right side of the vamp means. The edge of the label is then aligned with the tacker foot so that the line tack 326 will be in alignment with the topstitch seam 310. A tack of about one inch is sewed in the label.

Figure 35:
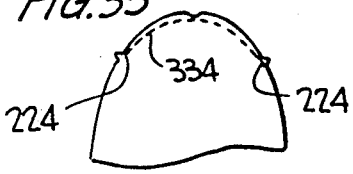
Figure 34:
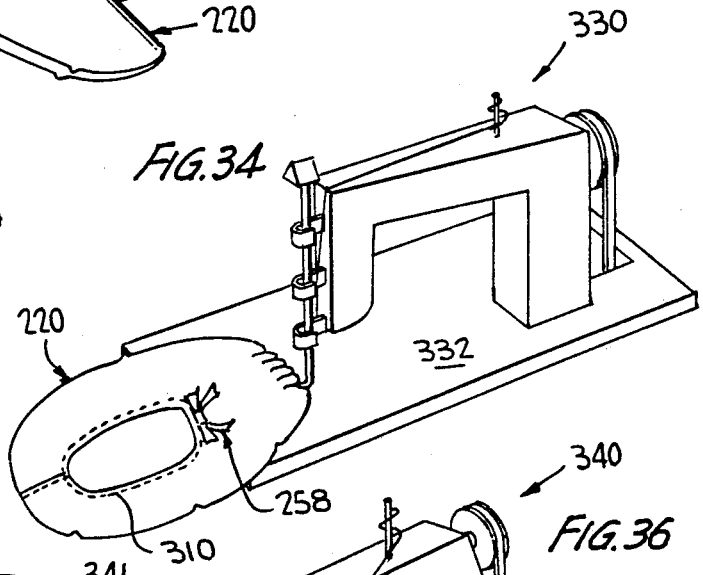

Referring to FIG. 34, a conventional shirr machine 330 is provided with a supporting surface 332. The vamp is placed right side up on the machine with the toe toward the machine foot. Sewing is started at the vamp toe notch 224 to the left of the center toe notch as seen in FIG. 35 and continues to the toe notch 224 to the right of the center toe notch to form a line of stitching 334. This shirring gathers the toe portion of the slipper to provide fullness thereat for receiving a person's toes.

Figure 37:
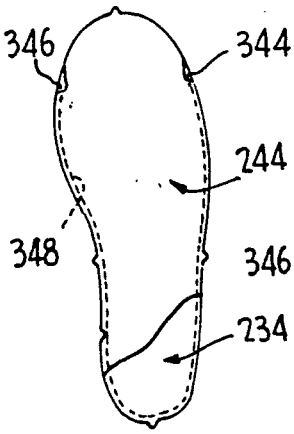
Figure 36:
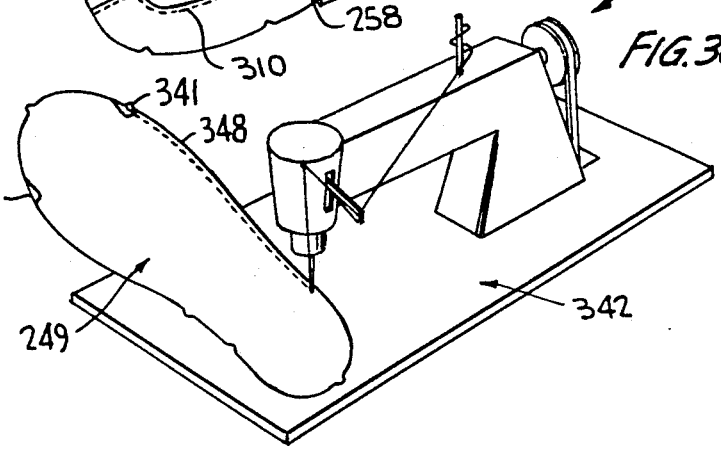

Referring to FIGS. 36 and 37, the heel and side portions of the innersole means and sock means are attached to one another while leaving an opening at the toe portions thereof. A conventional sewing machine 340 having a support surface 342 is provided. The sock means 234 is placed on the machine with the wrong or smooth side up and with the heel toward the operator.

The innersole means 244 is placed on top of the sock means with the innersole means facing the wrong side of the sock means, aligning the out notches and edges on the innersole means and sock means. Sewing is started at point 344 at one extended point on the innersole means and continues toward the heel. The heel edges are aligned, and sewing continues to a point 346 at the extended point on the innersole means on the opposite side of the innersole means, thereby forming a line of stitching 348.

Figure 38:
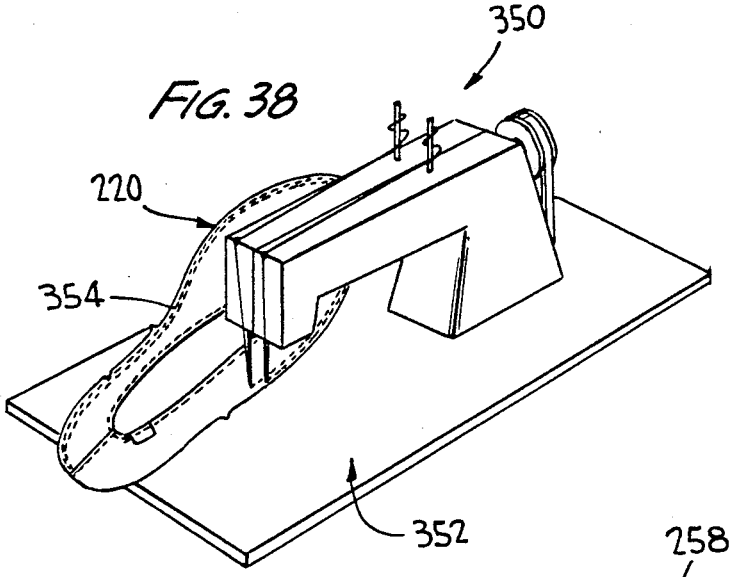
Figure 39:
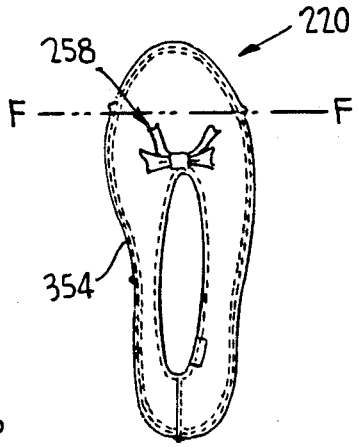

Referring to FIGS. 38 and 39, the vamp means is attached to the innersole means and sock means, leaving an opening at the toe portions of the innersole means and sock means. A conventional walking foot machine 350 having a support surface 352 is set up with a ⅛ inch gauge with an outside altered foot and roller gauge to double needle the vamp means to the sock means and innersole means.

The same procedure is followed for both left and right slippers in these steps of the method. A sock means is placed on the machine with the right side up, and the heel toward the machine foot. A vamp means is placed right side up on the sock means, aligning the heel seam on the sock means heel out notch. Sewing is started at the heel seam toward the toe, aligning the sides of the sock means and vamp means as the sewing continues. A double line of stitching 354 is formed attaching the vamp means to the innersole means and sock means.

When the stitching approaches the toe portion of the slipper, the innersole means is folded under the slipper and back toward the heel along a fold line indicated by phantom line F—F in FIG. 39 to prevent the innersole means from being stitched to the sock means and vamp means forwardly of line F—F as seen in FIG. 39. This ensures that the opening between the toe portions of the innersole means and sock means remains open after the method steps shown in FIG. 38 and 39.

The vamp means toe shirring is centered on the sock means and the edges are aligned as sewing continues around the toe to line F—F. The innersole means is then folded forward toward the toe. The sides of the vamp means and sock means are aligned and sewing continues toward the heel seam. It is noted that the vamp means will again be stitched to the innersole means as well as the sock means as the stitching moves rearwardly of line F—F in FIG. 39. Sewing continues to the heel seam and about ¾ inch beyond the heel seam. The operator then chains to the next sock.

Figure 40:
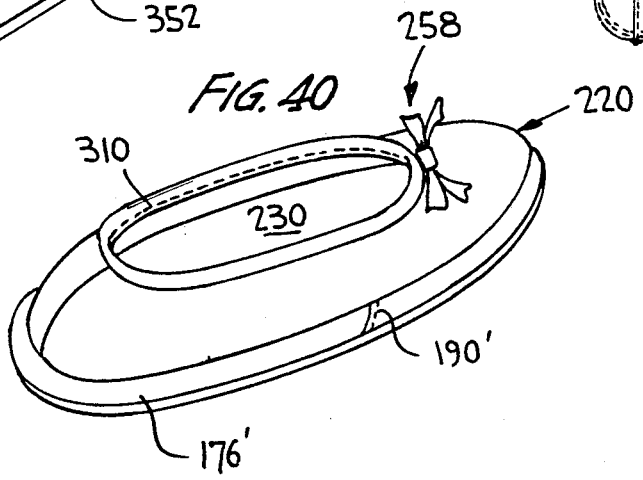
FIG. 40 is a top perspective view of a finished ballerina type of slipper

The remaining steps of making the ballerina type slipper are the same as those previously described in connection with FIGS. 11–16, and no further description of such steps is necessary. A finished ballerina slipper according to the invention is shown in FIG. 40. Parts corresponding to those of the scuff type slipper have been given the same reference character primed. It will be understood that a cross-section taken through the slipper shown in FIG. 40 along a line similar to line 18—18 of FIG. 17 would have the same appearance as FIG. 18 except that the cross-section of the vamp means would be different, consisting of two layers of stretch terrycloth adhesively bonded together at the wrong sides thereof.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. The method of making a slipper comprising providing an innersole, providing a sock having a right side and a wrong side, providing a vamp having a right side and a wrong side, interconnecting peripheral portions of said innersole, sock and vamp with one another and leaving an opening at the toe portions of said innersole and sock, providing an elongated flexible filler having a length and a width, providing a clamping means, clamping said filler with said clamping means along a substantial portion of the length of the filler, inserting the clamping means and the clamped filler through said opening into a space between said inner sole and said sock, unclamping said filler, removing said clamping means from said space, connecting binding to peripheral portions of said innersole, sock and vamp and closing said opening, and interconnecting a sole pad with said innersole, sock and vamp.

2. The method as defined in claim 1 wherein peripheral portions of said innersole, sock and vamp are interconnected with the innersole facing the wrong side of said sock and the wrong side of the vamp facing the right side of the sock.

3. The method as defined in claim 1 wherein said sole pad is interconnected with said innersole, sock and vamp by forming a line of stitching passing through peripheral portions of said sole pad.

4. The method as defined in claim 1 wherein said vamp includes a vamp having a right side and a wrong side and also includes a vamp lining having a right side and a wrong side, and including the steps of forming said vamp by placing the right side of said vamp in facing relationship to the right side of said vamp lining, attaching portions of the vamp and vamp lining to one another, turning said attached portions inside out, and attaching further portions of the vamp and vamp lining to one another.

5. The method as defined in claim 1 wherein said vamp includes a vamp having a right side and a wrong side, and including forming said vamp by folding said vamp with right sides facing one another, aligning the heel edges of the vamp, serging the heel edges to form a serge seam, folding the serge seam to one side and topstitching the seam.

6. The method as defined in claim 5 including attaching elastic around the vamp throat, an then topstitching the vamp throat.

7. The method of making a slipper comprising interconnecting peripheral portions of an innersole, sock and vamp with one another and leaving an opening at the toe portions of said innersole and sock, inserting a filler including a body of cushioning material through said opening into a space between said innersole and said sock, connecting binding to peripheral portions of said innersole, sock and vamp and closing said opening, and interconnecting a sole pad with said innersole, sock and vamp, and wherein the step of inserting said filler comprises clamping the filler in place in an assembling area, pulling the interconnected innersole, sock and vamp over the clamped filler, unclamping the filler, and removing the assembled components from the assembling area.

8. The method of making a slipper comprising providing an innersole, providing a sock having a right side and a wrong side, providing a vamp having a right side and a wrong side, attaching heel portions of said innersole and sock to one another leaving an opening at the toe portions thereof, attaching said vamp to said innersole and sock leaving said opening at the toe portions of the innersole and sock, providing an elongated flexible filler having a length and a width, providing a clamping means, clamping said filler with said clamping means along a substantial portion of the length of the filler, inserting the clamping means and the clamped filler through said opening into a space between said innersole and said sock, unclamping said filler, removing said clamping means from said space, applying binding around the periphery of the slipper with the binding receiving peripheral portions of said innersole, sock and vamp, attaching said binding to the received peripheral portions thereby closing said opening, and attaching a sole pad to said innersole, sock, vamp and binding.

9. The method as defined in claim 8 including the step of folding back the toe portion of said innersole while attaching said vamp to said innersole and said sock to leave said opening.

10. The method as defined in claim 8 wherein said binding is applied by folding the binding to define a space for receiving the peripheral portions of said innersole, sock and vamp, and inserting said peripheral portions in said space.

11. The method as defined in claim 8 wherein peripheral portions of said innersole, sock and vamp are interconnected with the innersole facing the wrong side of said sock and the wrong side of the vamp facing the right side of the sock.

12. The method as defined in claim 8 wherein said sole pads is interconnected with said innersole, sock and vamp by forming a line of stitching passing through peripheral portions of said sole pad.

13. The method as defined in claim 8 wherein said vamp includes a vamp having a right side and a wrong side and also includes a vamp lining having a right side and a wrong side, and including the steps of forming said vamp by placing the right side of said vamp in facing relationship to the right side of said vamp lining, attaching portions of the vamp and vamp lining to one another, turning said attached portions inside out, and attaching further portions of the vamp and vamp lining to one another.

14. The method as defined in claim 8 wherein said vamp includes a vamp having a right side and a wrong side, and including forming said vamp by folding said vamp with right sides facing one another, aligning the heel edges of the vamp, serging the heel edges to form a serge seam, folding the serge seam to one side and topstitching the seam.

15. The method as defined in claim 14 including attaching elastic around the vamp throat, and then topstitching the vamp throat.

16. The method of making a slipper comprising attaching heel portions of an innersole and sock to one another leaving an opening at the toe portions thereof, attaching a vamp to said innersole and sock leaving said opening at the toe portions of the innersole and sock, inserting a filler including a body of cushioning material through said opening into a space between said innersole and said sock, applying binding around the periphery of the slipper with the binding receiving peripheral portions of said innersole, sock and vamp, attaching said binding to the received peripheral portions thereby closing said opening, and attaching a sole pad to said innersole, sock, vamp and binding, and wherein the step of inserting said filler comprises clamping the filler in place in an assembling area, pulling the interconnected innersole, sock and vamp over the clamped filler, unclamping the filler, and removing the assembled components from the assembling area.

* * * * *